US007379556B2

(12) United States Patent
Maekawa et al.

(10) Patent No.: US 7,379,556 B2
(45) Date of Patent: May 27, 2008

(54) SPEAKER DEVICE

(75) Inventors: Koji Maekawa, Yamagata (JP); Hiroyuki Dohi, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 5 days.

(21) Appl. No.: 10/397,851

(22) Filed: Mar. 27, 2003

(65) Prior Publication Data

US 2004/0028246 A1 Feb. 12, 2004

(30) Foreign Application Priority Data

Mar. 28, 2002 (JP) ..... 2002-091762

(51) Int. Cl.
*H04R 25/00* (2006.01)

(52) U.S. Cl. ..... 381/338; 381/337; 381/345

(58) Field of Classification Search ..... 381/96, 381/337, 338, 345–351, 353, 354; 181/148, 181/155, 156, 160, 196–199
See application file for complete search history.

(56) References Cited

U.S. PATENT DOCUMENTS

| | | | | |
|---|---|---|---|---|
| 5,031,500 | A * | 7/1991 | Koike et al. | 84/600 |
| 5,875,255 | A * | 2/1999 | Campbell | 381/345 |
| 5,917,923 | A * | 6/1999 | Caron et al. | 381/345 |
| 6,522,759 | B1 * | 2/2003 | Mori | 381/150 |

FOREIGN PATENT DOCUMENTS

| | | |
|---|---|---|
| JP | 05-041896 | 2/1993 |
| JP | 06-038290 | 2/1994 |
| JP | 2001-016673 | 1/2001 |

* cited by examiner

*Primary Examiner*—Huyen Le
(74) *Attorney, Agent, or Firm*—Nixon & Vanderhye, PC

(57) ABSTRACT

A speaker device includes an acoustic capacity unit; an acoustic pipe connected to the acoustic capacity unit; and a driving speaker attached to the acoustic capacity unit. The acoustic capacity unit and the acoustic pipe constitute the Helmholtz resonator, and resonate at a predetermined Helmholtz resonant frequency. On the other hand, the acoustic pipe itself has a resonant frequency. By setting the resonant frequency of the acoustic pipe to be 0.5 to 2.5 octaves higher than the Helmholtz resonant frequency, the speaker device can be obtained which outputs signals of continuous frequency band from the Helmholtz resonant frequency to the resonant frequency of the acoustic pipe.

22 Claims, 7 Drawing Sheets

S: CROSS SECTION OF ACOUSTIC PIPE
B: ACOUSTIC CAPACITANCE
L: LENGTH OF ACOUSTIC PIPE
C: SONIC VELOCITY

CONDITION IN ACOUSTIC PIPE AT FREQUENCY
LOWER THAN HELMHOLTZ RESONANT FREQUENCY

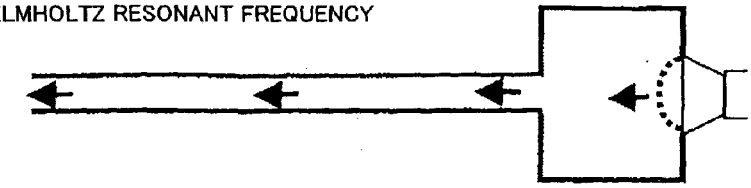

Fig. 3A

CONDITION IN ACOUSTIC PIPE
AT HELMHOLTZ RESONANT FREQUENCY

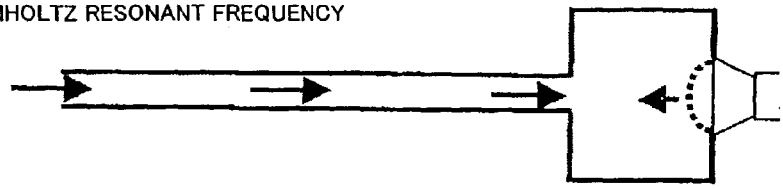

Fig. 3B

CONDITION IN ACOUSTIC PIPE AT FREQUENCY
HIGHER THAN HELMHOLTZ RESONANT FREQUENCY

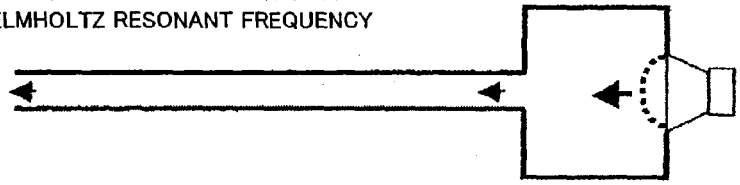

Fig. 3C

FIRST HARMONIC OF RESONANCE
WHEN ONE END OF ACOUSTIC PIPE IS OPEN

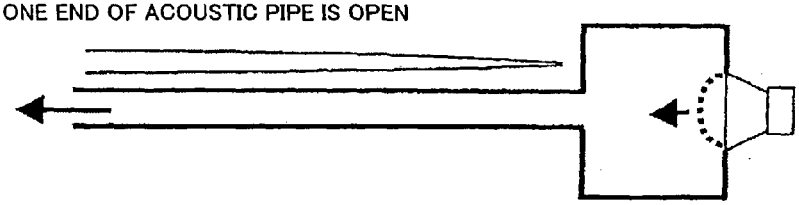

Fig. 3D

THIRD HARMONIC OF RESONANCE
WHEN ONE END OF ACOUSTIC PIPE IS OPEN

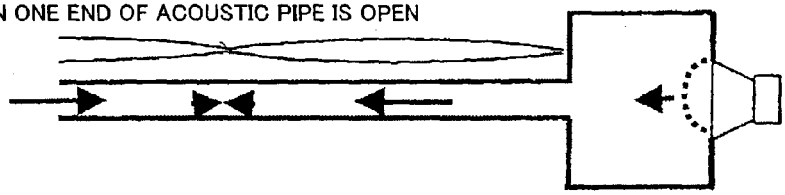

Fig. 3E

FIRST HARMONIC OF RESONANCE
WHEN BOTH ENDS OF ACOUSTIC PIPE ARE OPEN

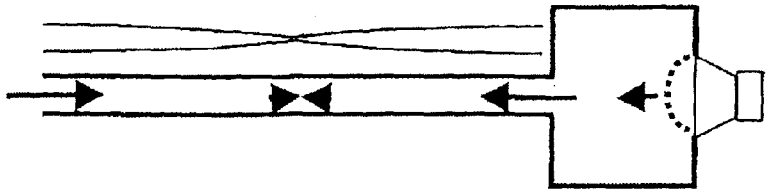

Fig. 3F m0: Vibration System Equivalent Mass of SP unit
C0: Vibration System Compliance
BL: Force Coefficient
Re: Direct Current Resistance of Voice Coil
Rm: Mechanical Resistance of Supporting system
L1: Inductor of High-Cut Filter
R1: DCR of Inductor
C1: Capacitor
mp: Air Mass in Acoustic Pipe
Ra: Air Viscous Drag
Cc: Compliance of Acoustic Capacitance

SPEAKER DEVICE

BACKGROUND OF THE INVENTION

1. Field of the Invention

This invention relates to a speaker device, and more particularly to a speaker device which is small in size and has an excellent in low-frequency sound reproduction ability.

2. Description of Related Art

Examples of a low-frequency sound speaker (also called "bass speaker") device for reproducing sound of low-frequency band with relatively flat frequency characteristic are disclosed in Japanese Patent Applications Laid-Open under Nos. 5-41896, 6-38290 and 2001-16673. However, in a speaker device having a port ("Bass Reflex type" and "Kelton type"), since the port is short and its pipe resonant frequency is high, the pipe resonant frequency of the port is remote from the Helmholtz resonant frequency caused by the mass of air in the port and the compliance in a cabinet. Therefore, when the pipe resonance is positively used, it is difficult to practically obtain low-frequency sound reproduction by combining those two resonances.

SUMMARY OF THE INVENTION

This invention is made in view of the above, and its object is to provide a speaker device which is small in size and is capable of reproducing desired low-frequency band signal with as flat frequency characteristic as possible.

According to one aspect of the present invention, there is provided a speaker device including: an acoustic capacity unit; an acoustic pipe connected to the acoustic capacity unit; and a driving speaker attached to the acoustic capacity unit, wherein a resonant frequency of the acoustic pipe is 0.5 to 2.5 octaves higher than a Helmholtz resonant frequency caused by the acoustic capacity unit and the acoustic pipe.

The above speaker device is configured such that the acoustic pipe and the driving speaker are attached to the acoustic capacity unit of a predetermined capacity. The acoustic capacity unit and the acoustic pipe constitute the Helmholtz resonator, and resonate at a predetermined Helmholtz resonant frequency. On the other hand, the acoustic pipe itself has a resonant frequency. By setting the resonant frequency of the acoustic pipe to be 0.5 to 2.5 octaves higher than the Helmholtz resonant frequency, the speaker device which outputs signals of continuous frequency band from the Helmholtz resonant frequency to the resonant frequency of the acoustic pipe can be obtained. The resonant frequency of the acoustic pipe may be adjusted by varying the length of the acoustic pipe itself, for example.

In the above speaker device, the Helmholtz resonant frequency may be a predetermined low frequency. According to a preferred embodiment, the Helmholtz resonant frequency may be within a range from 50 Hz to 55 Hz, and the resonant frequency of the acoustic pipe may be within a range from 160 Hz to 180 Hz. By this, a bass speaker which outputs acoustic signals in the frequency band from approximately 50 Hz to 200 Hz may be configured.

The above speaker device may further include a filter circuit which is provided between the driving speaker and an audio source and which includes a reactance and/or a capacitance. In this case, by appropriately setting the characteristic of the filter circuit, the frequency characteristic of the speaker device between the Helmholtz resonant frequency and the resonant frequency of the acoustic pipe may be flattened to obtain a speaker device of a preferable characteristic.

In that case, the filter circuit may cause an electric resonance with a reactance component of an electric impedance of the driving speaker viewed from a side of its terminal at a frequency band between the Helmholtz resonant frequency and the resonant frequency of the acoustic pipe to increase an acoustic pressure level. Also, the filter circuit may cause an electric resonance with a reactance component of an electric impedance of the driving speaker viewed from a side of its terminal at a frequency band between the Helmholtz resonant frequency and the resonant frequency of the acoustic pipe, in which a sound pressure is lower than a predetermined value, to increase an acoustic pressure level.

Further, the filter circuit may have a characteristic which attenuates signals having higher frequency than the resonant frequency of the acoustic pipe. By this, the speaker device may attenuate the signals of unnecessary frequency band, which is higher than the resonant frequency of the acoustic pipe, to output only the signals of a desired frequency band.

The nature, utility, and further features of this invention will be more clearly apparent from the following detailed description with respect to preferred embodiment of the invention when read in conjunction with the accompanying drawings briefly described below.

BRIEF DESCRIPTION OF THE DRAWINGS

FIGS. 3A to 3F are diagrams for explaining an operation of the speaker device according to the first embodiment.

DETAILED DESCRIPTION OF THE PREFERRED EMBODIMENTS

The preferred embodiments of the present invention will be described below with reference to the attached drawings.

1st Embodiment

Figure 1:
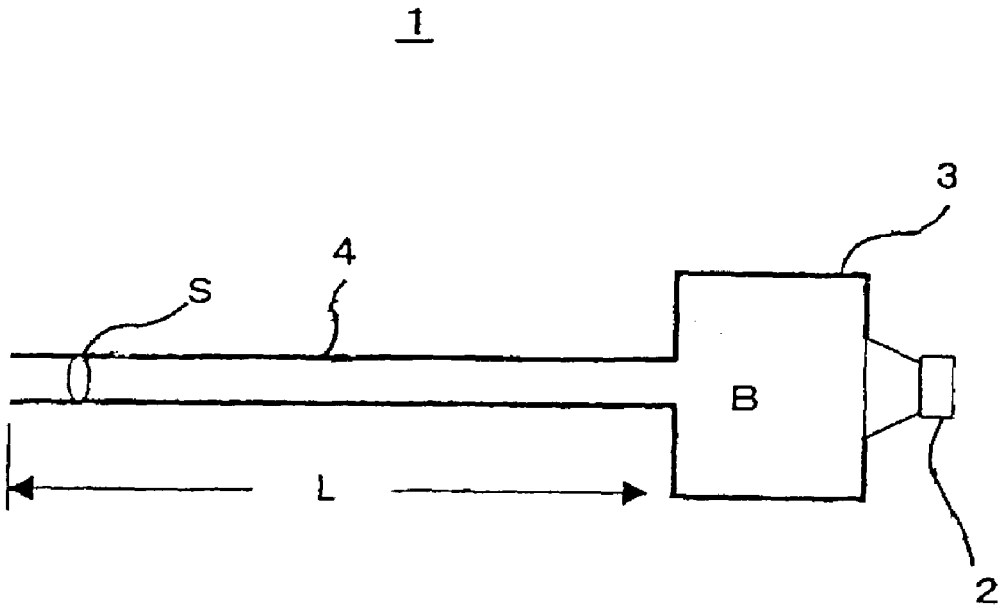
FIG. 1 is a diagram schematically showing a configuration of a speaker device according to a first embodiment of the present invention.

FIG. 1 schematically shows a configuration of a speaker device according to a first embodiment of the present invention. As shown, the speaker device 1 according to the present invention is for reproducing low-frequency sound, and is configured to have a frequency characteristic as flat as possible in the frequency band between approximately 50 Hz to 200 Hz.

As shown, the speaker device 1 includes a driving speaker 2, an acoustic capacitance unit 3, and an acoustic pipe 4. In the speaker device 1, the acoustic capacitance unit 3 and the acoustic pipe 4 constitute, in combination, a Helmholtz resonator. Thus, the speaker device 1 causes resonances at two frequencies, i.e., a resonant frequency as a Helmholtz resonator formed by the acoustic capacitance unit 3 and the acoustic pipe 4, and a resonant frequency of the acoustic pipe 4 by itself. As shown in FIG. 1, when the cross section of the acoustic pipe 4 is expressed by "S", the acoustic capacitance of the acoustic capacitance unit 3 is expressed by "B", the length of the acoustic pipe 4 is expressed by "L", and the sonic velocity is expressed by "C", the Helmholtz resonant frequency $f_0$ and the resonant frequency f of the acoustic pipe 4 of the speaker 1 are as follows:

$$\text{Helmholtz resonant frequency } f_0 = \frac{C}{2\pi}\sqrt{\frac{S}{LB}}$$

$$\text{Resonant frequency of pipe when both ends open } f = \frac{C}{2L}$$

$$\text{Resonant frequency of pipe when one end open } f = \frac{C}{4L}$$

It is noted that the resonant frequency of the acoustic pipe 4 is different between the cases where the both ends of the acoustic pipe 4 are open and where only one end of the acoustic pipe 4 is open.

To the driving speaker 2, an electric signal is supplied via an electric filter (not shown). The electric filter attenuates unnecessary high-frequency component of the electric signal so that the speaker device 1 functions as a bass speaker (low-frequency reproduction speaker). The filter will be hereinafter referred to as "high-frequency component attenuating filter".

Figure 2:
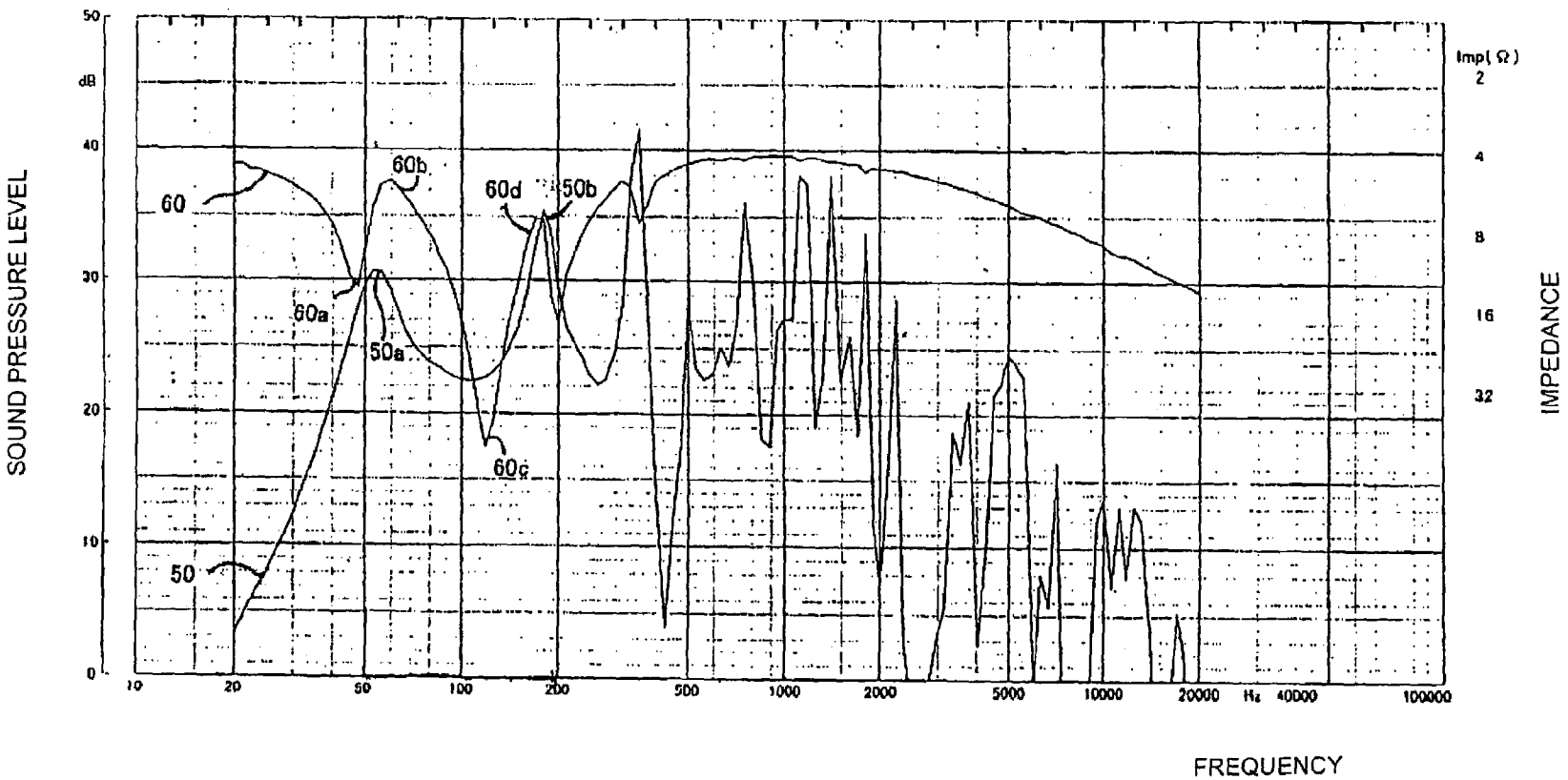
FIG. 2 is a graph showing an impedance characteristic and a sound pressure frequency characteristic of the speaker device according to the first embodiment of the present invention.

FIG. 2 shows a sound pressure frequency characteristic and an electric impedance characteristic of the speaker device 1. The characteristic 50 is the sound pressure frequency characteristic, for which the value on the horizontal axis indicates the frequency and the value on the (left side) vertical axis indicates the sound pressure level. The characteristic 60 is the electric impedance characteristic of the above-mentioned high-frequency component attenuating filter, for which the value on the horizontal axis indicates the frequency and the value on the (right side) vertical axis indicates the impedance. It is noted that the larger impedance value is shown at lower position along the vertical axis of the graph.

In FIG. 2, in the direction from low frequency to high frequency, the peak 50*a* of the sound frequency characteristic 50 between approximately 50 Hz to 55 Hz is caused by the Helmholtz resonance, and specifically it represents the resonant frequency determined by the compliance of the acoustic capacity B and the air mass in the acoustic pipe 4. In this example, the Helmholtz resonance occurs at 50 to 55 Hz. When the air in the acoustic capacity B is vibrated by the driving speaker 2, the sound is output with maximum sound pressure from the open end of the acoustic pipe 4 at the Helmholtz resonant frequency.

On the other hand, the peak 50*b* of the sound pressure frequency characteristic 50 at 160 to 180 Hz is caused by the resonance of the acoustic pipe 4 itself, and specifically it occurs at a frequency between the resonant frequency of the acoustic pipe 4 when its both ends are open and the resonant frequency of the acoustic pipe 4 when only one end is open. As shown in FIG. 1, since the acoustic capacity B exists on the right side of the acoustic pipe 4, the resonant frequency of the acoustic pipe 4 is located between the resonant frequencies when its both ends are open and when its one end is open.

In this way, by configuring the speaker device 1 such that the resonant frequency of the acoustic pipe 4 is located within the range 0.5 to 2.5 octaves higher than the Helmholtz resonant frequency (e.g., 50 Hz), the frequency characteristic in which the sound pressure level is continuous in a desired low-frequency band (e.g., 50 to 200 Hz) may be obtained.

Next, the operation of the speaker device 1 will be described for each frequency, with reference to FIGS. 3A to 3F. FIG. 3A shows the condition in the acoustic pipe 4 at the frequency lower than the Helmholtz resonant frequency. The air in the acoustic pipe 4 moves with approximately same phase with the vibration plate of the driving speaker 2, however the sound pressure is lowered because the air is controlled by the compliance of the supporting system of the driving speaker 2. Between approximately 40 Hz and 50 Hz in FIG. 2, the resonance occurs by the total mass of weight of the speaker vibration system and the weight of the air in the acoustic pipe 4, and the compliance of the driving speaker 2, and hence the peak 60*a* is caused in the impedance characteristic 60 (In FIG. 2, the impedance value is shown to be higher to the lower direction).

FIG. 3B shows the condition in the acoustic pipe 4 at the Helmholtz resonant frequency. The air in the acoustic pipe 4 is driven with the reverse phase of the vibration plate, with the compliance of the acoustic capacity functioning as a spring. In the sound pressure frequency characteristic 50 in FIG. 2, the peak 50*a* of the Helmholtz resonance is caused between 50 Hz and 60 Hz.

FIG. 3C shows the condition in the acoustic pipe higher than the Helmholtz resonant frequency. The mass of the air in the acoustic pipe 4 cannot be driven by the compliance of the acoustic capacity B, and hence the sound pressure level takes a low value. In this case, the air in the acoustic pipe 4 cannot move much. The resonance is caused by the mass of the vibration system of the driving speaker 2 and the total compliance of the driving speaker 2 and the acoustic capacity B, and the peak 60*c* is caused on the impedance characteristic 60 between 100 Hz and 150 Hz.

FIGS. 3D to 3F show the condition of the acoustic pipe 4 at the frequency approximately 160 to 180 Hz. FIG. 3D shows the first harmonic of the resonance in the case that one end of the acoustic pipe 4 is open, FIG. 3E shows the third harmonic of the resonance in the case that one end of the acoustic pipe 4 is open, and FIG. 3F shows the first harmonic of the resonance in the case that both ends of the acoustic pipe 4 are open. As shown, the resonance by the acoustic pipe 4 itself is caused between 160 Hz to 180 Hz, and the peak 50*b* is caused on the sound pressure frequency characteristic 50.

As described above, by the Helmholtz resonance caused by the acoustic capacity unit 3 (having the peak at 50 Hz to 60 Hz) and the acoustic pipe 4 and the resonance of the acoustic pipe 4 by itself (having the peak at 160 Hz to 180 Hz), the frequency characteristic maintains high sound pressure level at a desired low-frequency range from 50 Hz to 200 Hz, and hence the speaker device 1 can be used as a bass speaker. It is noted that, in the sound pressure frequency characteristic shown in FIG. 2, the frequency band higher than 200 Hz can be attenuated by the above-mentioned high-frequency component attenuating filter.

2nd Embodiment

Next, the speaker device according to the second embodiment of the present invention will be described. The speaker device according to the first embodiment can be used as a bass speaker for the frequency range from 50 Hz to 200 Hz. However, as shown in the sound pressure frequency characteristic of FIG. 2, if the sound pressure level of the range centered on 100 Hz is increased, a bass speaker having a flatter frequency characteristic may be obtained.

As understood from the impedance characteristic 60 in FIG. 2, the electric impedance value is considerably high and the sound pressure level is low accordingly at the peak 60*c* of the impedance characteristic 60 around 100 Hz. As already mentioned, since it is necessary to connect the high-frequency component attenuating filter to the driving speaker 2 in order to use the speaker device 1 as an exclusive bass speaker, the constants of the filter elements may be adjusted to decrease the electric impedance of the filter around 100 Hz. By this, the electric resonance can be caused by the reactance of the speaker around 100 Hz and the filter elements to increase the sound pressure level around 100 Hz. It is noted that the filter is also designed to attenuate unnecessary high frequency component at the same time.

Figure 4A:
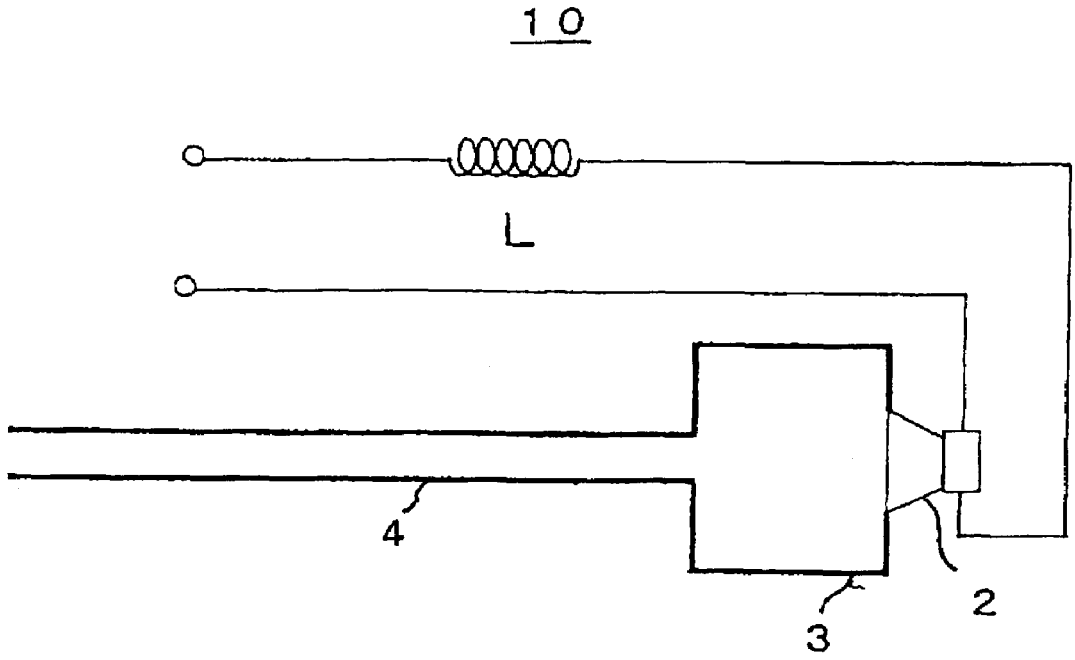
FIGS. 4A and 4B are diagrams schematically showing a configuration of a speaker device according to a second embodiment of the present invention.
Figure 4B:
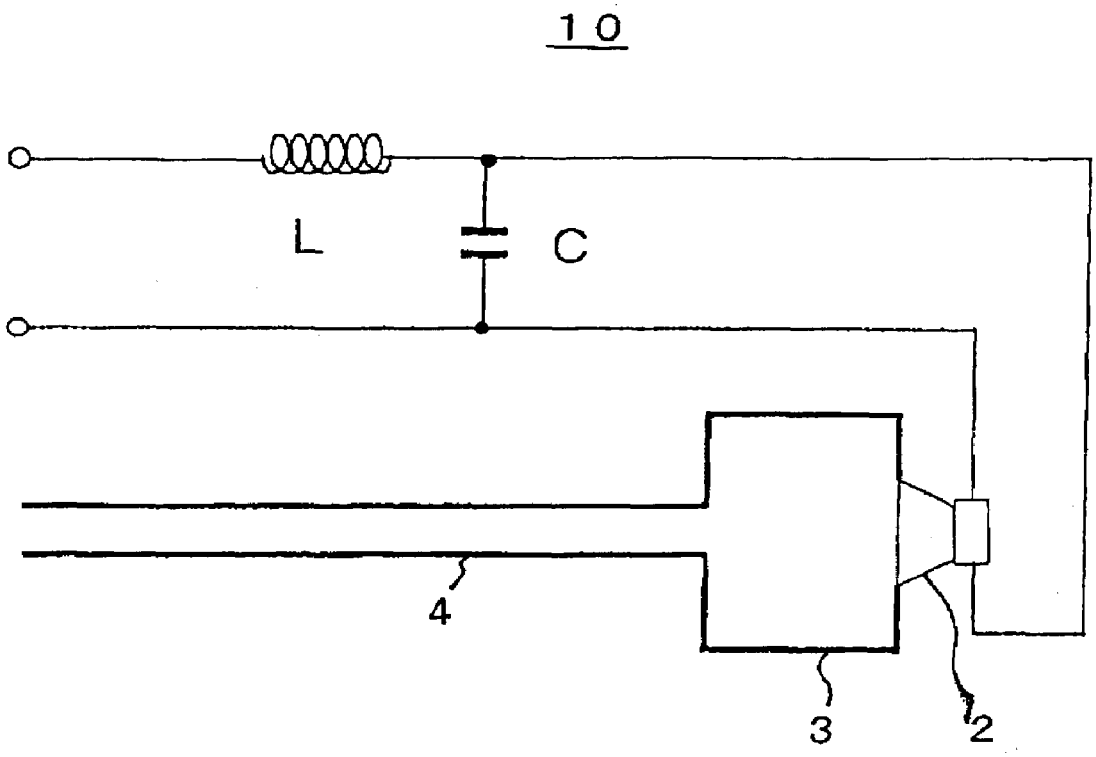

FIG. 4 shows a schematic configuration of a speaker device 10 according to the second embodiment, employing such a filter. The speaker device 10 of the second embodiment has the same configuration as the speaker device 1 of the first embodiment, except that the above-mentioned filter is added to the driving speaker 2 as an electric circuit. FIG. 4A shows an example in which an inductor L is inserted to the electric circuit connected to the driving speaker 2, and FIG. 4B shows another example in which an inductor L and a capacitor C are inserted to the electric circuit connected to the driving speaker 2.

Figure 5:
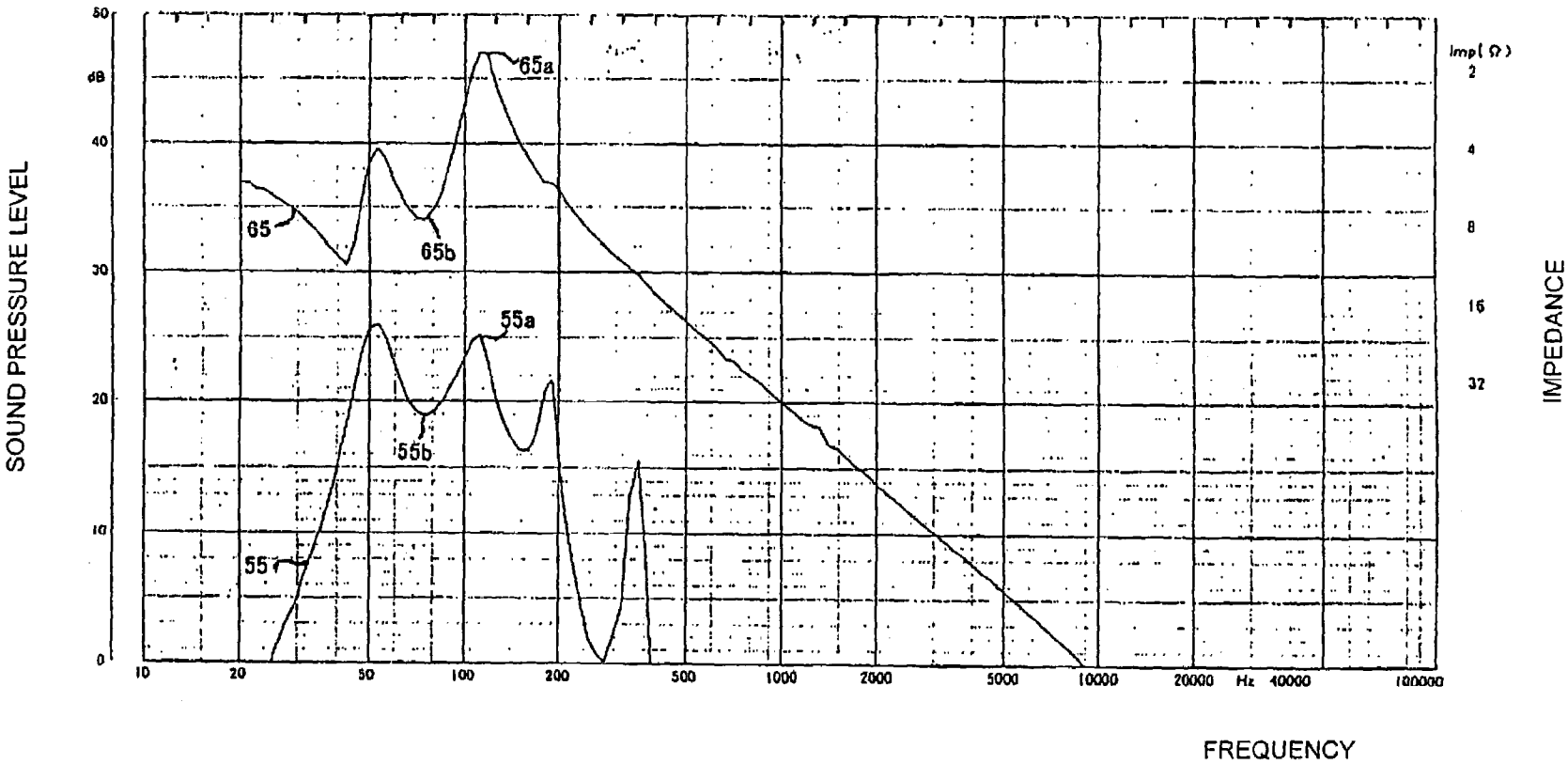
FIG. 5 is a graph showing an impedance characteristic and a sound pressure frequency characteristic of the speaker device according to the second embodiment of the present invention.

FIG. 5 shows the sound pressure frequency characteristic 55 and the impedance characteristic 65 of the speaker device 10 under the condition that the inductor L=6 mH and the capacitor C=330 μF in the configuration of FIG. 4B. By inserting the resonant circuit having the inductor L and the capacitor C shown in FIG. 4B, the impedance value around 100 Hz is decreased and the bottom in the sound pressure frequency characteristic 60 is raised up. As a result, a flatter frequency characteristic is achieved in the range of 50 Hz to 200 Hz, compared with the characteristic of the speaker device 1 shown in FIG. 2.

Next, the values of the inductor L and the capacitor C in the speaker device 10 shown in FIG. 4B will be studied by using an equivalent circuit. The following study gives the impedance characteristic and the sound pressure characteristic of the example shown in FIG. 5, causing two resonances within the low-frequency range from 50 Hz to 200 Hz. The first resonance is caused at the peak 65*b* of the impedance characteristic 65 on the low-frequency side, and the bottom 55*b* is caused on the sound pressure frequency characteristic 55 in correspondence with the peak 65*b*. Another resonance is caused at bottom 65*a* of the impedance characteristic 65 on the high-frequency side, and the peak 55*a* is caused on the sound pressure frequency characteristic 55 in correspondence with the bottom 65*a*.

Figure 6A:
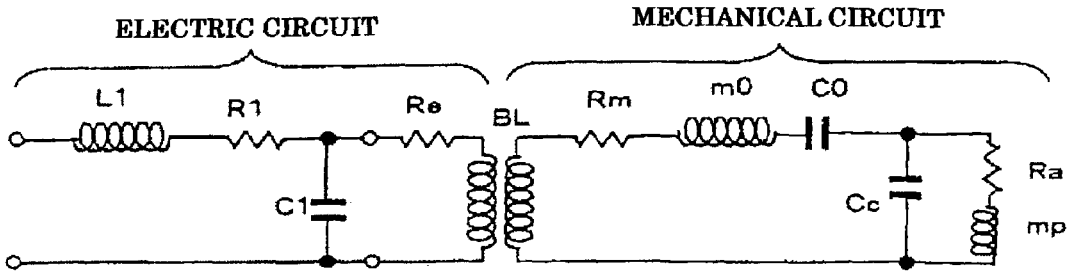
FIGS. 6A to 6D are circuit diagrams of an equivalent circuitry of the second embodiment.

FIG. 6A shows an equivalent circuit of the speaker device 10. It is noted that the values of the elements in the equivalent circuit are defined as shown in FIG. 6A. First, the mechanical circuit shown in FIG. 6A is converted to the electric circuit. The mechanical circuit part around the peak 60*c* of the impedance characteristic shown in FIG. 2 decreases the air vibration in the acoustic pipe 4, and the resonance is caused by the condenser C of the mass of the vibration system and the inductance L0 of the total compliance of the driving speaker 2 and the acoustic capacity B. The electric impedance Ze of the speaker device in the low-frequency band can be expressed by the mechanical impedance Zm as follows:

$$Ze = Re + \frac{(BL)^2}{Zm}$$

Around the peak 60*c* of the impedance characteristic 60 in FIG. 2, the mechanical resistance is neglected as follows:

$$Ze = Re + \frac{(BL)^2}{j\left(\omega m0 - \frac{1}{\omega c}\right)}$$

By this electric impedance Ze, a mechanical resonance is caused when ωm0=1/ωC, and at that time the electric impedance becomes minimum and the mechanical impedance becomes maximum. From the equation of the electric impedance Ze when the direct-current resistance of the voice coil of the driving speaker is neglected:

$$Ze = \frac{(BL)^2}{j\left(\omega m0 - \frac{1}{\omega c}\right)}$$

the mechanical resonant angular frequency is:

$$\omega = \sqrt{\frac{1}{m0 * C}}$$

Figure 6B:
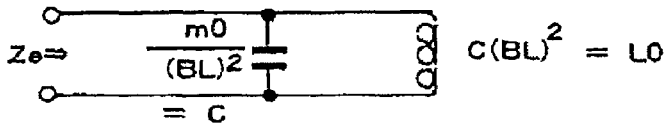
Figure 6C:
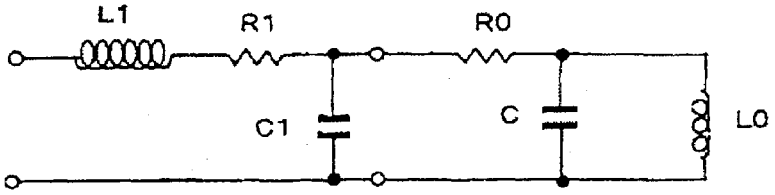
Figure 6D:
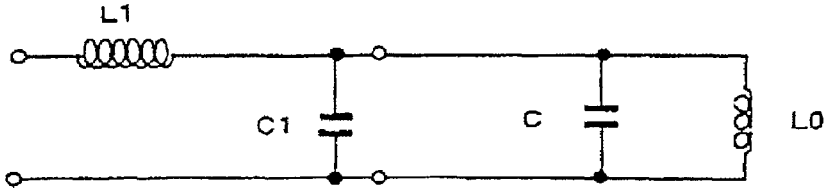

The electric impedance is the parallel circuit shown in FIG. 6B by which the impedance is maximum at the resonant point. The peak 60*c* on the impedance characteristic 60 in FIG. 2 corresponds to this. However, since the air vibration in the acoustic pipe 4 is small, the sound pressure at the opening of the acoustic pipe 4 is low. FIG. 6C shows the equivalent electric circuit of FIG. 6B, to which electric elements for filter that also have a high-frequency component attenuating function are added.

In order to increase the sound pressure at the Helmholtz resonant frequency and the resonant frequency of the acoustic pipe, the resonance is caused by the reactance by the equivalent elements on the side of the driving speaker and the electric elements. If resistors are omitted to obtain only the resonant frequency, the equivalent circuit shown in FIG.

6D is obtained. Based on this equivalent circuit, the electric impedance is calculated to obtain the resonant frequency of the electric circuit. The electric impedance Ze is given by:

$$
\begin{aligned}
Ze &= j\omega L1 + \frac{1}{\frac{1}{j\omega L0} + \frac{1}{\frac{1}{j\omega C1}} + \frac{1}{\frac{1}{j\omega C}}} \\
&= j\omega L1 + \frac{1}{\frac{1}{j\omega L0} + j\omega C1 + j\omega C} \\
&= j\omega L1 + \frac{1}{\frac{1}{j\omega L0} + \frac{\omega^2 C1L0}{j\omega L0} - \frac{\omega^2 CL0}{j\omega L0}} \\
&= j\omega L1 + \frac{j\omega L0}{1 - \omega^2 C1L0 - \omega^2 CL} \\
&= \frac{j\omega L1(1 - \omega^2 C1L0 - \omega^2 CL0) + j\omega L0}{1 - \omega^2 C1L0 - \omega^2 CL} \\
&= \frac{j\omega\{L1 + L0 - \omega^2(C1L0L1 + CL0L1)\}}{1 - \omega^2(C1L0 + CL0)}
\end{aligned}
$$

Since the (serial) resonance is obtained at a point where the impedance is minimum, it is a condition that the part in { } of the numerator of the above equation becomes zero. Namely, the following equations stand:

$$L1+L0-\omega^2(C1L0L1+CL0L1)=0$$

$$\omega^2 = \sqrt{\frac{L1 + L0}{C1L0L1 + CL0L1}}$$

and the resonant frequency f is given as follows:

$$f = \frac{1}{2\pi}\sqrt{\frac{L1 + L0}{C1L0L1 + CL0L1}}$$

This corresponds to the bottom 65*a* of the impedance characteristic 65 shown in FIG. 5 around 120 Hz.

Also, another (parallel) resonance is caused at the point where the impedance is maximum, it is the point where the denominator of the equation of Ze becomes zero, and the following conditions are required:

$$1-\omega^2(C1L0+CL0)=0$$

$$\omega^2 = \sqrt{\frac{1}{C1L0 + CL0}}$$

Therefore, the resonant frequency f is given as follows:

$$f = \frac{1}{2\pi}\sqrt{\frac{1}{C1L0 + CL0}}$$

This corresponds to the peak 65*b* on the impedance characteristic 65 shown in FIG. 5 around 70 Hz.

[Application to Speaker]

As described above, the speaker device of the present invention is configured by an acoustic pipe which is thinner and longer than that in a general Bass Reflex type speaker and an acoustic capacity which is smaller than a general Bass Reflex type speaker. Therefore, the speaker of the present invention has a flat frequency characteristic in a desired low-frequency range, despite of its small size, and can be used as a bass speaker.

Figure 7A:
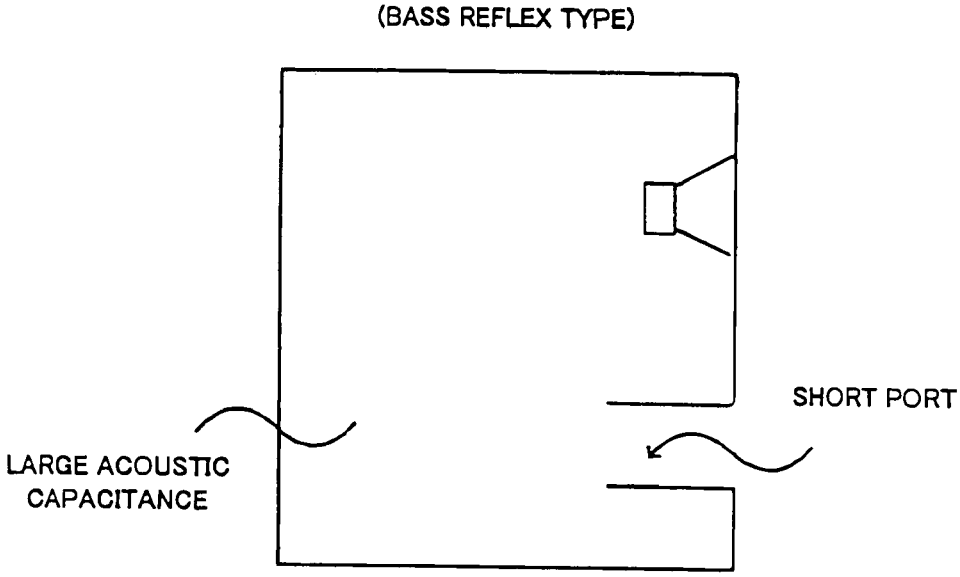
Fig. 7A (PRIOR ART)
FIGS. 7A and 7B are diagrams comparatively showing configurations of a conventional speaker and the speaker of the present invention.
Figure 7B:
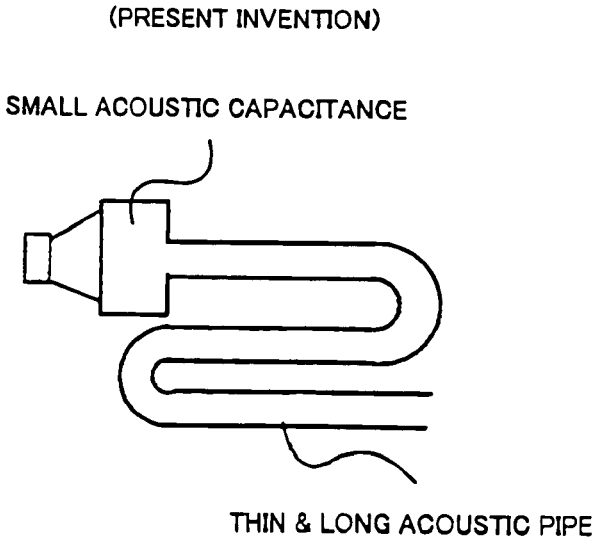

In this respect, while the acoustic pipe 4 is shown in FIGS. 1 and 4 as a straight shape for the sake of explanation, the acoustic pipe 4 may be curved and/or folded to be an U-shape or S-shape, for example, to save the space in the acoustic output direction. An example of this is shown in FIG. 7. The Bass Reflex type speaker shown in FIG. 7A has a short port, but needs a large acoustic capacity. On the contrary, in the speaker of the present invention, a thin and long acoustic pipe is curved in an U-shape or S-shape to be connected to a small acoustic capacity, as shown in FIG. 7B. Thus, the speaker of the present invention is a smaller in total size than the Bass Reflex type speaker but can provide the same Helmholtz resonant frequency.

Therefore, the bass speaker of the present invention may be advantageously applied to an on-vehicle speaker, a home-use speaker, a television speaker, a wall-hanging speaker, a speaker for personal computer, and so on.

As described above, the present invention provides a speaker device which can reproduce a desired low-frequency signal with as flat frequency characteristic as possible, despite of its small size.

The invention may be embodied on other specific forms without departing from the spirit or essential characteristics thereof. The present embodiments therefore to be considered in all respects as illustrative and not restrictive, the scope of the invention being indicated by the appended claims rather than by the foregoing description and all changes which come within the meaning an range of equivalency of the claims are therefore intended to be embraced therein.

The entire disclosure of Japanese Patent Application No. 2002-91762 filed on Mar. 28, 2002 including the specification, claims, drawings and summary is incorporated herein by reference in its entirety.

What is claimed is:

1. A speaker device comprising:

an acoustic capacity unit;

an acoustic pipe opening at one end to the acoustic capacity unit and at the other end to the outside of the speaker device; and a driving speaker attached to the acoustic capacity unit, wherein a resonant frequency of the acoustic pipe by itself is 0.5 to 2.5 octaves higher than a Helmholtz resonant frequency caused by the acoustic capacity unit and the acoustic pipe, wherein the resonant frequency of the acoustic pipe by itself is only dependent on a sonic velocity and a length of the acoustic pipe and is not dependent on an areal dimension of the acoustic pipe.

2. The speaker device according to claim 1, wherein the Helmholtz resonant frequency is a predetermined low-frequency.

3. The speaker device according to claim 1, wherein the Helmholtz resonant frequency is within a range from 50 Hz to 55 Hz, and wherein the resonant frequency of the acoustic pipe is within a range from 160 Hz to 180 Hz.

4. The speaker device according to claim 1, further comprising a filter circuit which is provided between the driving speaker and an audio source and which comprises a reactance and/or a capacitance.

5. The speaker device according to claim 4, wherein the filter circuit causes an electric resonance with a reactance component of an electric impedance of the driving speaker viewed from a side of its terminal, at a frequency band between the Helmholtz resonant frequency and the resonant frequency of the acoustic pipe, to increase an acoustic pressure level.

6. The speaker device according to claim 4, wherein the filter circuit causes an electric resonance with a reactance component of an electric impedance of the driving speaker viewed from a side of its terminal, at a frequency band between the Helmholtz resonant frequency and the resonant frequency of the acoustic pipe, in which a sound pressure is lower than a predetermined value, to increase an acoustic pressure level.

7. The speaker device according to claim 4, wherein the filter circuit has a characteristic which attenuates signals having higher frequency than the resonant frequency of the acoustic pipe.

8. The speaker device according to claim 1, wherein the acoustic pipe comprises a curved portion.

9. The speaker device according to claim 1, wherein the acoustic pipe comprises an S-shaped portion.

10. The speaker device according to claim 1, wherein the acoustic pipe comprises a U-shaped portion.

11. The speaker device according to claim 1, wherein at least a portion of the acoustic pipe projects outwardly from the acoustic cavity.

12. The speaker device according to claim 11, wherein the acoustic pipe comprises a curved portion.

13. The speaker device according to claim 11, wherein the acoustic pipe comprises a U-shaped portion.

14. A speaker device comprising:

a Helmholtz resonator comprising an acoustic capacity unit and an acoustic pipe for providing acoustic output to the outside of the speaker device; and a driving speaker attached to the acoustic capacity unit, wherein a resonant frequency of the acoustic pipe by itself is between about 0.5 and 2.5 octaves higher than a resonant frequency of the Helmholtz resonator comprising both the acoustic capacity unit and the acoustic pipe, and wherein the resonant frequency of the acoustic pipe by itself is only dependent on a sonic velocity and a length of the acoustic pipe and is not dependent on an areal dimension of the acoustic pipe.

15. The speaker device according to claim 14, wherein the resonant frequency of the Helmholtz resonator is between about 50 Hz and 55 Hz and the resonant frequency of the acoustic pipe by itself is between about 160 Hz and 180 Hz.

16. The speaker device according to claim 14, wherein the acoustic pipe comprises a curved portion.

17. The speaker device according to claim 14, wherein the acoustic pipe comprises a U-shaped portion.

18. The speaker device according to claim 14, further comprising:

a filter circuit provided between the driving speaker and an audio source.

19. The speaker device according to claim 18, wherein the filter circuit comprises a high-frequency component attenuating filter circuit.

20. The speaker device according to claim 14, wherein at least a portion of the acoustic pipe projects outwardly from the acoustic cavity.

21. The speaker device according to claim 20, wherein the acoustic pipe comprises a curved portion.

22. The speaker device according to claim 20, wherein the acoustic pipe comprises a U-shaped portion.

* * * * *